US011763791B2

(12) United States Patent
Thormundsson et al.

(10) Patent No.: US 11,763,791 B2
(45) **Date of Patent: *Sep. 19, 2023**

(54) NOISE AMPLIFICATION CONTROL IN ADAPTIVE NOISE CANCELLING SYSTEMS

(71) Applicant: Google LLC, Mountain View, CA (US)

(72) Inventors: Trausti Thormundsson, Irvine, CA (US); Ali Abdollahzadeh Milani, San Francisco, CA (US); Govind Kannan, Irvine, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/382,942

(22) Filed: Jul. 22, 2021

(65) Prior Publication Data

US 2021/0350782 A1 Nov. 11, 2021

Related U.S. Application Data

(63) Continuation of application No. 16/721,480, filed on Dec. 19, 2019, now Pat. No. 11,100,910.
(Continued)

(51) Int. Cl.
*G10K 11/178* (2006.01)

(52) U.S. Cl.
CPC .. *G10K 11/17854* (2018.01); *G10K 11/17881* (2018.01); *G10K 2210/3026* (2013.01);
(Continued)

(58) Field of Classification Search
CPC ..... G10K 11/17854; G10K 11/17881; G10K 2210/3026; G10K 2210/3027;
(Continued)

(56) References Cited

U.S. PATENT DOCUMENTS 7,082,205 B1 * 7/2006 Westermann ..... H04R 25/305 381/60
9,361,872 B2 6/2016 Park et al.
(Continued)

FOREIGN PATENT DOCUMENTS

JP 2008-060759 A 3/2008
JP 2008-300894 A 12/2008
WO WO-2008029336 A1 * 3/2008 ..... G10K 11/1788

OTHER PUBLICATIONS

International Preliminary Report on Patentability for International Application No. PCT/US2019/067644 dated Jul. 1, 2021. 14 pages.
(Continued)

*Primary Examiner* — Vivian C Chin
*Assistant Examiner* — Douglas J Suthers
(74) *Attorney, Agent, or Firm* — Kilpatrick Townsend & Stockton LLP

(57) ABSTRACT

Adaptive noise cancellation systems and methods comprise a reference sensor operable to sense environmental noise and generate a corresponding reference signal, an error sensor operable to sense noise in a noise cancellation zone and generate a corresponding error signal, a noise cancellation filter operable to receive the reference signal and generate an anti-noise signal to cancel the environmental noise in the cancellation zone, an adaptation module operable to receive the reference signal and the error signal and adaptively adjust the anti-noise signal.

18 Claims, 6 Drawing Sheets

Related U.S. Application Data

(60) Provisional application No. 62/782,305, filed on Dec. 19, 2018.

(52) U.S. Cl.
CPC ..... *G10K 2210/3027* (2013.01); *G10K 2210/3028* (2013.01); *G10K 2210/3056* (2013.01)

(58) Field of Classification Search
CPC ... G10K 2210/3028; G10K 2210/3044; G10K 11/17827; H04R 3/04; H04R 5/033; H04R 5/04; H04R 2460/01; G10L 21/0232
USPC ..... 381/71.11
See application file for complete search history.

(56) References Cited

U.S. PATENT DOCUMENTS

| | | | | |
|---|---|---|---|---|
| 9,392,364 | B1 * | 7/2016 | Milani | H04R 3/002 |
| 9,578,432 | B1 | 2/2017 | Abdollahzadeh Milani et al. | |
| 9,741,334 | B2 | 8/2017 | Park et al. | |
| 2010/0014685 | A1 * | 1/2010 | Wurm | G10K 11/17823 381/71.11 |
| 2012/0140917 | A1 | 6/2012 | Nicholson et al. | |
| 2014/0072134 | A1 | 3/2014 | Po et al. | |

OTHER PUBLICATIONS

Written Opinion and International Search Report for International App. No. PCT/US2019/067644, 17 pages.

* cited by examiner

NOISE AMPLIFICATION CONTROL IN ADAPTIVE NOISE CANCELLING SYSTEMS

CROSS-REFERENCE TO RELATED APPLICATIONS

The present application is a continuation application of U.S. patent application Ser. No. 16/721,480, filed on Dec. 19, 2019, which claims priority to and the benefit of U.S. Provisional Patent Application No. 62/782,305, filed on Dec. 19, 2018, the disclosures of which are hereby incorporated herein by reference.

TECHNICAL FIELD

The present application relates generally to noise cancelling systems and methods, and more specifically, for example, to adaptive noise cancelling systems and methods for use in headphones (e.g., circum-aural, supra-aural and in-ear types), earbuds, hearing aids, and other personal listening devices.

BACKGROUND

Adaptive noise cancellation (ANC) systems commonly operate by sensing noise through a reference microphone and generating a corresponding anti-noise signal that is approximately equal in magnitude, but opposite in phase, to the sensed noise. The noise and anti-noise signal cancel each other acoustically, allowing the user to hear only a desired audio signal. To achieve this effect, a low-latency, programmable filter path from the reference microphone to a loudspeaker that outputs the anti-noise signal may be implemented. In operation, conventional anti-noise filtering systems do not completely cancel all noise, leaving residual noise and/or generating audible artefacts that may be distracting to the user. There is therefore a continued need for improved adaptive noise cancellation systems and methods for headphones, earbuds and other personal listening devices.

SUMMARY

Systems and methods are disclosed for providing noise amplification control for adaptive noise cancellation in audio listening devices. In various embodiments, adaptive noise cancellation systems and methods provide improved hiss control and suppression.

In one or more embodiments, an adaptive noise cancellation system includes a reference sensor operable to sense environmental noise and generate a corresponding reference signal, an error sensor operable to sense noise in a noise cancellation zone and generate a corresponding error signal, a noise cancellation filter operable to receive the reference signal and generate an anti-noise signal to cancel the environmental noise in the cancellation zone, an adaptation module operable to receive the reference signal and the error signal and adaptively adjust the anti-noise signal. The adaptation module includes a noise amplification control module operable to adaptively control noise amplification in at least one hiss region of the anti-noise signal, while achieving cancellation in non-hiss regions of the anti-noise signal.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

Figure 1:
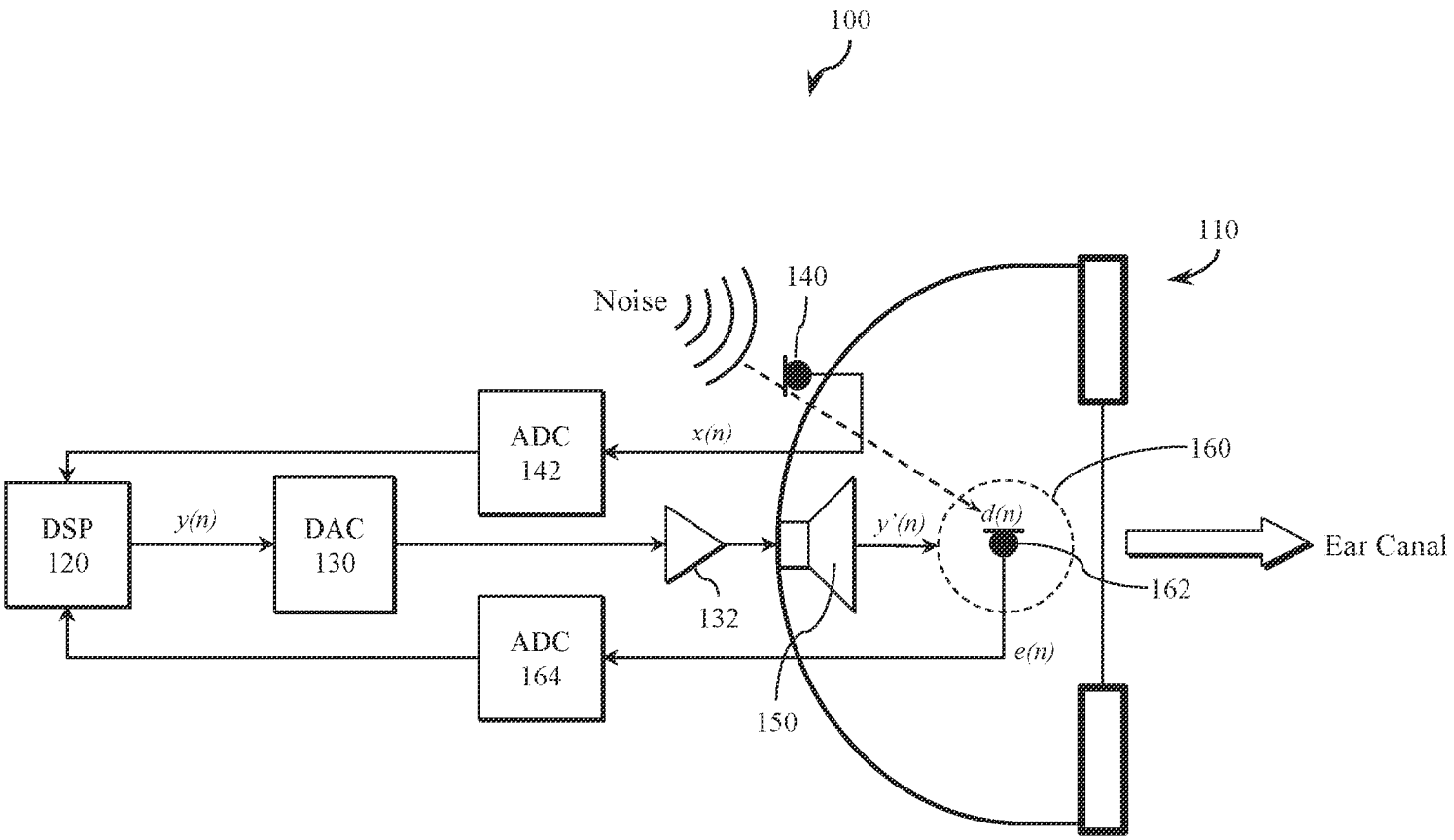
FIG. 1 illustrates an adaptive noise cancellation headset in accordance with one or more embodiments of the present disclosure.

In accordance with various embodiments, improved adaptive noise cancellation (ANC) systems and methods are disclosed. An ANC system for a headset or other personal listening device may include a noise sensing reference microphone for sensing environmental noise, an error microphone for sensing an acoustic mixture of the noise and anti-noise generated by the ANC device, and a signal processing sub-system that generates the anti-noise to cancel the environmental noise. The signal processing sub-system may be configured to continually adjust the anti-noise signal to achieve consistent cancellation performance across users, environmental noise conditions, and device units. In various embodiments, the adaptation systems and methods disclosed herein improve cancellation of environmental noise and reduce perceptible adaptation artefacts.

The present disclosure addresses numerous challenges associated with general purpose adaptive noise cancellation systems, including unwanted noise amplification (e.g., due to constructive interference between the environmental noise and the anti-noise signal), noise cancellation performance during transient noise events, and reduction of audible artefacts produced during adaptation. The systems and methods disclosed herein provide robust, practical ANC solutions that generalize well to various listening devices and form-factors.

In various embodiments, systems and methods are disclosed to reduce noise amplification that occurs when there is constructive interference between noise and anti-noise within a frequency range. Adaptive methods are disclosed which include defining a composite error signal that incorporates a noise-shaping filter and deriving a new weight update rule for controlling the adaptation. The solutions disclosed herein are adaptive, computationally inexpensive, and may be implemented as an improvement to conventional adaptive frameworks.

In various embodiments, systems and methods disclosed herein reduce adaptation artefacts that may be perceived by a listener. For example, low sound pressure level (SPL) artefacts may be present due to the proximity of the anti-noise source to the listener's ear drum. It is further recognized that some artefacts are caused by wideband fluctuations in the magnitude and phase response of the anti-noise path. Improved adaptive systems and methods disclosed herein include an adaptive gain element in the anti-noise signal path to generate a robust error correcting signal.

In various embodiments, systems and methods disclosed herein provide improved robustness to transient noise events. Many intermittent and unexpected noise events (e.g., head/jaw movement that moves the microphones relative to the noise, closing a door, turbulence during air travel, etc.) produce low frequency transients that can potentially disrupt the adaptation loop, leaving unwanted residual noise or producing noise artefacts. In various embodiments, a transient activity detector (TAD) tracks transient behavior and controls adaptation during transient activity.

Example embodiments of adaptive noise cancelling systems of the present disclosure will now be described with reference to the figures. Referring to FIG. 1, an adaptive noise cancelling system 100 includes an audio device, such as headphone 110, and audio processing circuitry, such as digital signal processor (DSP) 120, a digital to analog converter (DAC) 130, an amplifier 132, a reference microphone 140, a loudspeaker 150, an error microphone 162, and other components.

In operation, a listener may hear external noise d(n) through the housing and components of the headphone 110. To cancel the noise d(n), the reference microphone 140 senses the external noise, producing a reference signal x(n) which is fed through an analog-to-digital converter (ADC) 142 to the DSP 120. The DSP 120 generates an anti-noise signal y(n), which is fed through the DAC 130 and the amplifier 132 to the loudspeaker 150 to generate anti-noise in a noise cancellation zone 160. The noise d (n) will be cancelled in the noise cancellation zone 160 when the anti-noise is equal in magnitude and opposite in phase to the noise d(n) in the noise cancellation zone 160. The resulting mixture of noise and anti-noise is captured by the error microphone 162 which generates an error signal e(n) to measure the effectiveness of the noise cancellation. The error signal e(n) is fed through ADC 164 to the DSP 120, which adjusts the magnitude and phase of the anti-noise signal y(n) to minimize the error signal e(n) within the cancellation zone 162 (e.g., drive the error signal e(n) to zero). In some embodiments, the loudspeaker 150 may also generate desired audio (e.g., music) which is received by the error microphone 162 and removed from the error signal e(n) during processing. It will be appreciated that the embodiment of FIG. 1 is one example of an adaptive noise cancellation system and that the systems and methods disclosed herein may be implemented with other adaptive noise cancelling implementations that include a reference microphone and an error microphone.

Figure 2:
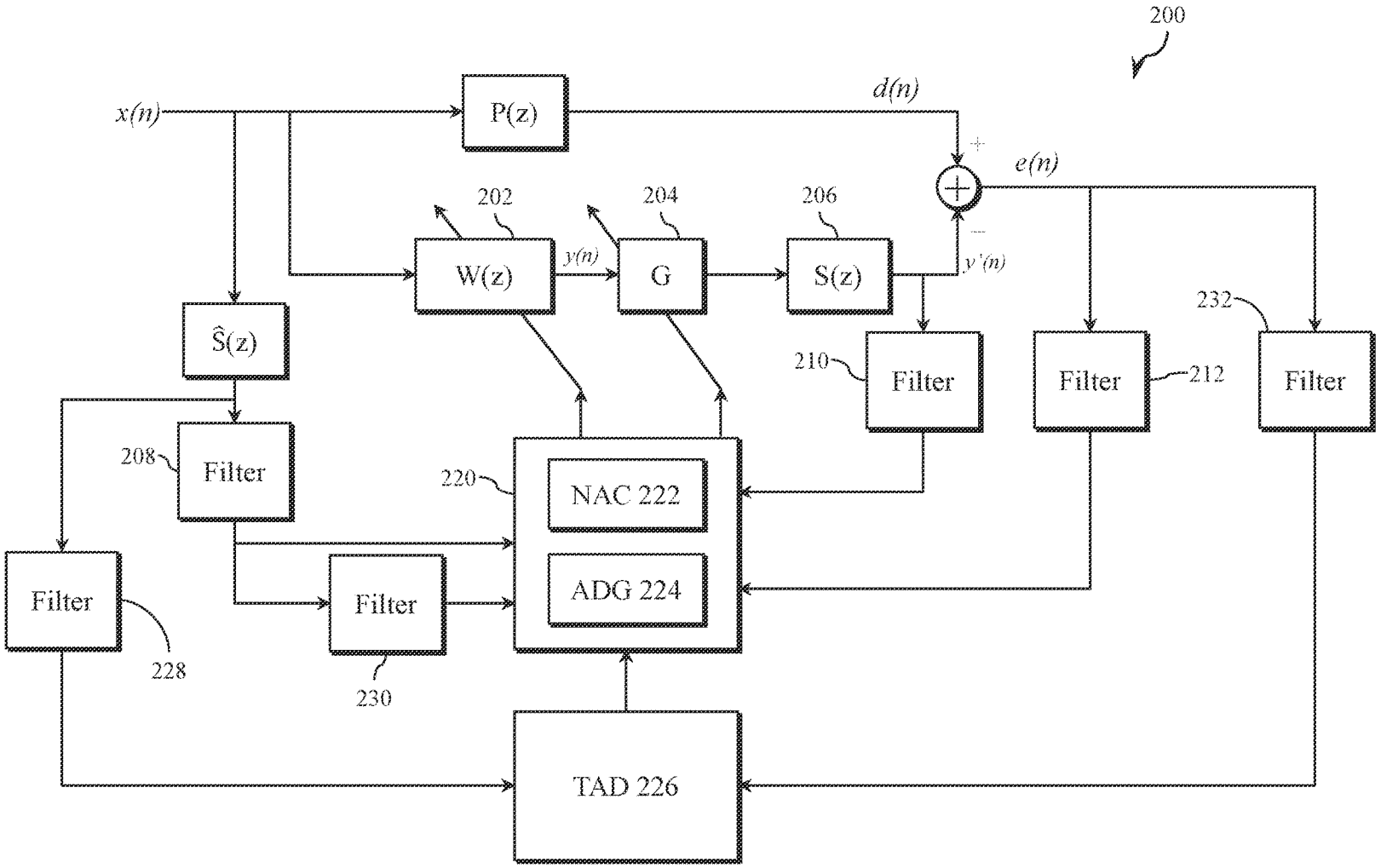
FIG. 2 illustrates an adaptive noise cancellation system in accordance with one or more embodiments of the present disclosure.

FIG. 2 illustrates a robust, configurable adaptive noise cancelling system 200 that achieves improved noise cancellation performance, substantially free of audio artefacts. The system 200 senses environmental noise at an external microphone (e.g., microphone 140 of FIG. 1) which produces an external noise signal, x(n). The environmental noise also passes through a noise path P(z), including the housing and components of the listening device, where it is received as d(n) at an error microphone (e.g., error microphone 162). An adaptive filter 202 receives the external noise signal x(n) and estimates the noise path P(z) to produce an anti-noise signal y(n) for cancelling the noise signal d(n). The anti-noise signal y(n) is gain adjusted by adaptive gain control 204 and further modified by system 206 to account for the secondary path S(z) between the adaptive filter 202 and the error microphone.

The system 200 further includes an adaptation block 220, which includes a noise amplification control (NAC) block 222 and an adaptive gain control block (ADG) 224. In various embodiments, the NAC 222 is operable to minimize frequency dependent constructive interference, and the ADG 224 is operable to minimize wide-band fluctuations in the anti-noise path. The system 200 further includes a transient activity detector (TAD) 226, which is operable to control the system 200 in response to sudden noise fluctuations and impulsive environmental events. The filters 208, 210, 212, 228, 230, 232 provide additional filtering as described further herein with reference to FIGS. 3-5.

Figure 3:
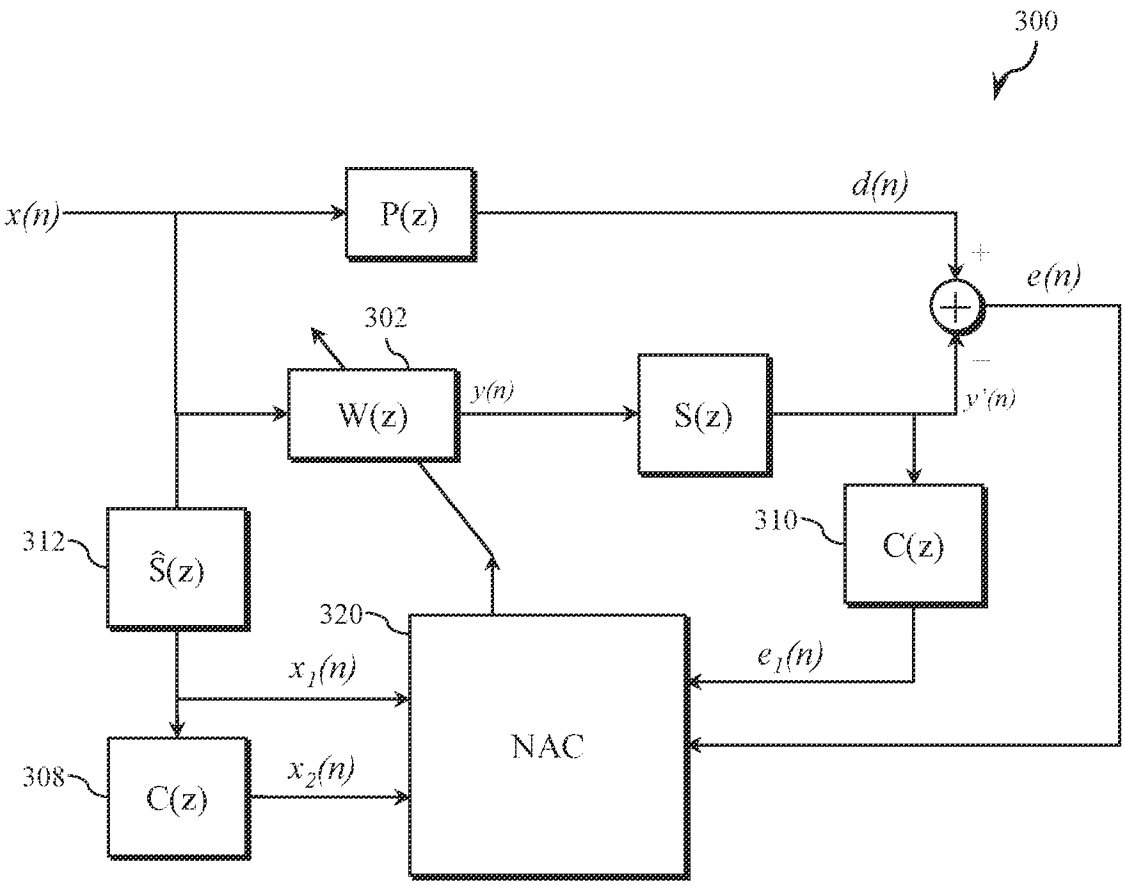
FIG. 3 illustrates an adaptive noise cancellation system, including a noise amplification control subsystem, in accordance with one or more embodiments of the present disclosure.

Referring to FIG. 3, embodiments of a noise amplification control (NAC) sub-system 300 will now be described. A goal of many adaptive noise cancellation systems is to estimate the noise at the ear drum of the listener. This is often accomplished by using the noise measurements from the reference and error microphones, which are located a small distance from the ear drum. The estimated noise is then inverted into an anti-noise signal that destructively interferes with the actual noise leading to cancellation of the noise. The anti-noise signal is produced using a filter that adapts to estimate the amplitude and phase shift for each frequency to align the anti-noise with the noise. Depending on the latency and the physical transfer functions at issue, the destructive interference may be maintained in certain bandwidths, while constructive interference may be experienced beyond these bandwidths. This constructive interference may be perceived by the listener as a narrowband amplification of the ambient noise (e.g., a "hiss" sound). Reducing or eliminating the "hiss" sound without sacrificing the depth and bandwidth of cancellation is a challenge in many ANC product designs. In conventional, low power embedded systems (e.g., consumer headphones) reduction of hiss may be computationally prohibitive and hard to control and tune.

The NAC sub-system 300 of FIG. 3 provides an approach for controlling hiss and related sound artefacts that adaptively controls the noise amplification in hiss regions, while efficiently achieving cancellation in non-hiss regions. An NAC block 320 is configured to define a composite error signal that incorporates a noise-shaping filter C(z) (e.g., noise shaping block 308 and noise shaping block 310) and derive new weight update rules for the adaptive filter 302. In some embodiments, a least mean squares (LMS) framework may be used, including a composite error signal that incorporates the noise-shaping filter that is used to derive a new weight update rule.

In operation, the NAC block 320 updates the adaptive filter 302, W(z), based on the error signal e(n) and a filtered version of the reference signal, x(n). In the illustrated embodiment, the NAC block 320 receives a signal $x_1(n)$ from filter 312, S(z), and signal $x_2(n)$ from filter 308, C(z). The cost function minimizes the mean square error: Minimize $E\{e^2(n)+\gamma E\{e_1^2(n)\}\}$. In various embodiments, the anti-noise signal is filtered using a noise-shaping filter C(z) (such as noise-shaping filter 308 and noise-shaping filter 310) which may be configured to enhance signals in the hiss region. In some embodiments, the hiss region for a particular headset may be detected, and the noise-shaping filter C(z) may be tuned, in a test environment prior to distribution. In some embodiments, the hiss level may be detected during operation and the noise-shaping filter C(z) may be adaptively tuned during operation. The hiss level may be determined, for example, by comparing the error signal, e(n), to the noise signal to determine regions of constructive interference.

The cost function is adapted to minimize $E\{e^2n+\gamma E\{e_1^2(n)\}\}$ where $E\{\cdot\}$ is the expectation operator, $\gamma$ is a constant that controls the aggressiveness, and $e_1n$ is noise-shaped anti-noise signal, y'(n). In some embodiments, a weight update rule is derived by the NAC 320 based on gradient methods. Embodiments of the method can be applied to filtered least mean squared approaches, adaptive feedback, adaptive hybrid approaches and other noise cancellation approaches. In various embodiments, the adaptation is controlled in a way that minimizes noise amplification by defining a cost function optimization and deriving an adaptive algorithm that can achieve it.

Figure 4A:
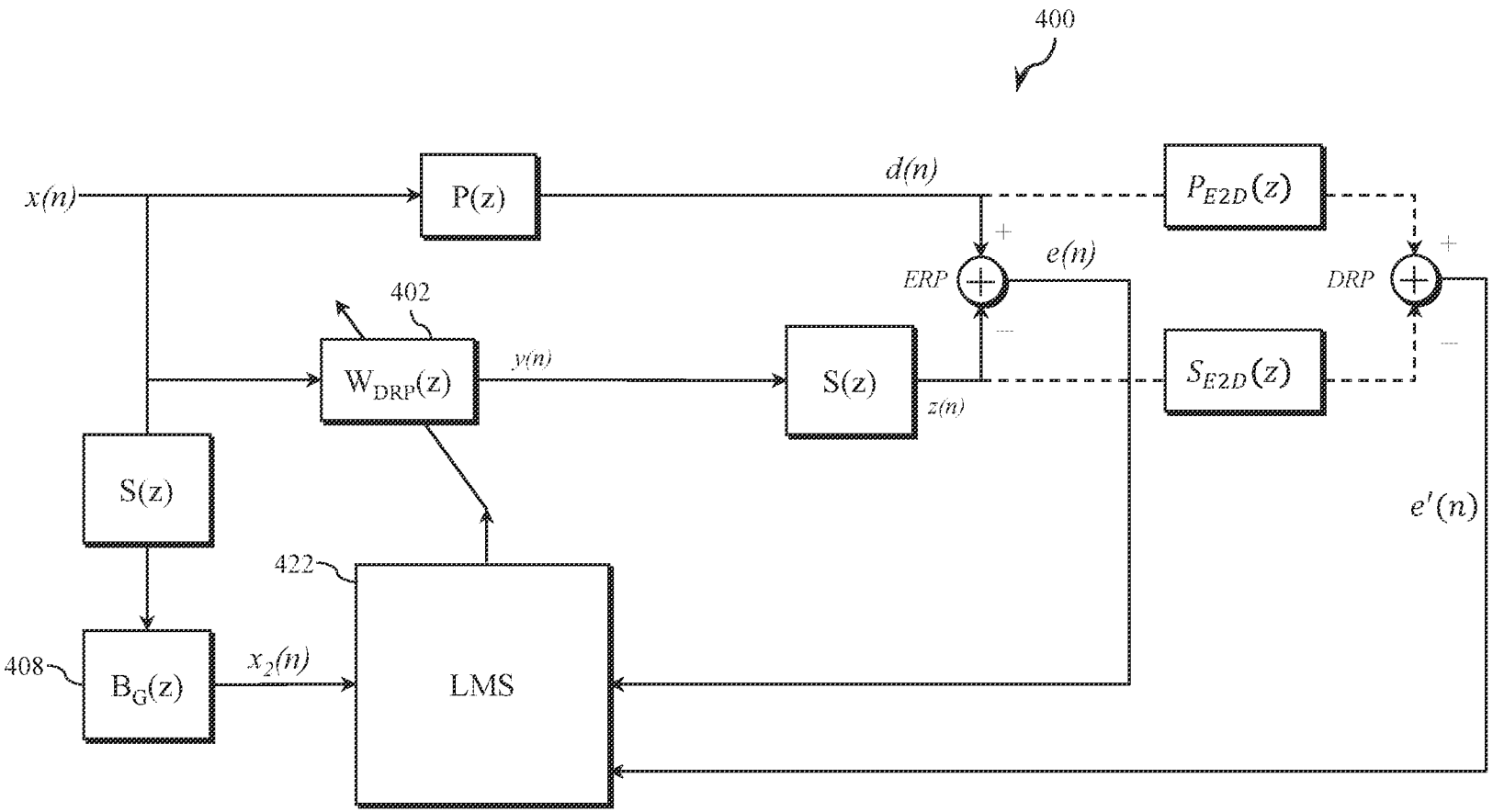
FIGS. 4A-B illustrate an adaptive noise cancellation system, including an adaptive gain control subsystem, in accordance with one or more embodiments of the present disclosure.
Figure 4B:
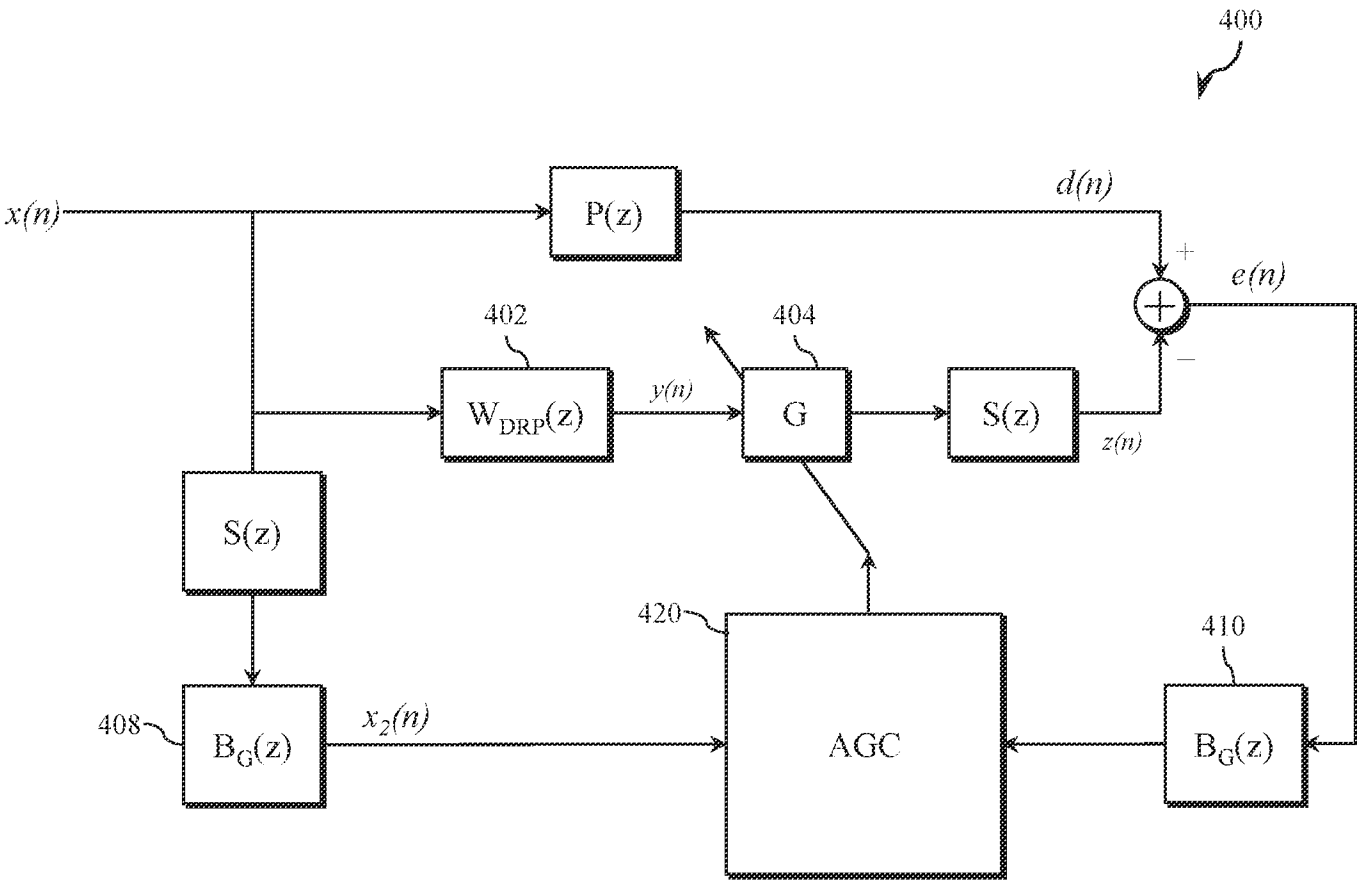

Referring to FIGS. 4A and 4B, embodiments of an adaptive gain (ADG) subsystem 400 are disclosed. In various embodiments, an adaptive gain control block 420 continuously updates a gain element 404 to adjust for variations in the various coupling paths. The inputs to the ADG are conditioned using a programmable filter $B_G(z)$ (e.g., programmable filter 408 and programmable filter 410), which is designed to protect against low frequency transients and high frequencies distractors in the environment. In some embodiments, the filter $B_G(z)$ may comprise a low pass filter and/or a band pass filter that further filters out very low frequencies (e.g., <20 Hz that cannot be heard out of a loudspeaker).

It will be appreciated that the physical geometries and person-to-person fit variations of the headphone can affect noise cancellation performance. For example, the shape of the outer ear and length of the ear canal can alter the acoustic transfer functions of interest in an ANC application. In some embodiments, an ANC system in a headphone or other personal listening device (e.g., the system of FIG. 1) uses a noise sensing reference microphone, an error microphone, and a DSP sub-system that generates the appropriate anti-noise to cancel the noise field as measured by the error microphone. This results in a cancellation zone where the degree of cancellation is maximized at the error microphone location and degrades inversely proportional to the wavelength. As a result, the cancellation performance at the eardrum (which is roughly 25 mm away from the error microphone) drops significantly for higher frequencies (lower wavelengths) leading to loss of cancellation bandwidth as perceived by the user of the noise cancelling system. The embodiments of FIGS. 4A-B address these and other issues by maximizing the cancellation bandwidth at the eardrum during the tuning stage and formulating an adaptive approach that uses the error microphone to adapt to user specific characteristics during operation.

For the purposes of this disclosure, let the error microphone location be termed as ERP (Error Reference Point) and the ear-drum location be termed as DRP (Drum Reference Point). For ANC systems tuned at the DRP, the error microphone is a good indicator of low frequency cancellation at DRP and hence a robust error correcting signal can be derived from a low-passed version of the error microphone signal. This correcting signal may then be used to adapt a gain in the anti-noise signal path.

To maximize cancellation, an ideal placement of an error microphone would be at the eardrum, but that location is not practical for many consumer devices. Thus, the ERP is used to provide a practical signal that is roughly indicative of the cancellation performance at the DRP. The adaptive algorithm attempts to minimize the ERP signal which results in (i) diminished cancellation at high frequency signals at the DRP, and (ii) higher possibility of hiss sounding artefacts due to constructive interference of high frequencies at the DRP. In conventional approaches, adaptive algorithms are employed that use the transfer function from ERP to DRP. These approaches have many drawbacks including that the transfer function estimation is inaccurate at high frequencies, low estimation accuracy can affect the broad band cancellation performance and cause transitory hiss levels, high computational costs, and difficulty to tune and calibrate for all use conditions making deployment impractical for many devices. The embodiments of FIGS. 4A-B provide a computationally inexpensive approach that overcomes many of the drawbacks of conventional systems, is easy to tune, for example by measuring certain transfer functions during system design, and is self-calibrating.

FIG. 4A illustrates a calibration and tuning arrangement for the adaptive gain subsystem. In this arrangement, the ANC filter 402 is optimized to cancel noise at the DRP during an initial tuning stage. In one embodiment, the device is placed on a head and torso simulator which has a second error microphone at the DRP. $P_{E2D}(Z)$, $S_{E2D}(Z)$ model the ERP to DRP transfer functions in the denoted acoustic paths. The system can then be optimized using least mean squares block 422 to perform ANC tuning to derive an optimum $W_{DRP}(Z)$, based on the error signal, e'(n). Tuning in this manner helps achieve extended cancellation bandwidth and better performance in high frequency bands. Second, as illustrated in FIG. 4B, the adaptive algorithm is set-up to continuously update a gain element 404, G, that empowers the proposed approach to adjust for variations in the various coupling paths. In some embodiments, the signal is low pass filtered and gain adjusted for good low frequency cancellation. Third, the inputs to the adaptive algorithms are conditioned using a programmable filter, $B_G(Z)$, which is programmed such that the ERP signal can mimic the cancellation performance at DRP. Additionally, $B_G(z)$, can be programmed to optimize performance during low frequency transients and high frequency distractors in the environment.

It will be appreciated that the embodiments of FIGS. 4A-B are example implementations, and that the approaches disclosed therein can be modified for adaptive versions of feedback, feedforward and hybrid ANC solutions. In some embodiments, instead of adapting a gain element, a purposefully constrained filter element can be adapted. The computed gain can have an additional non-linear processing to further increase the robustness.

Figure 5:
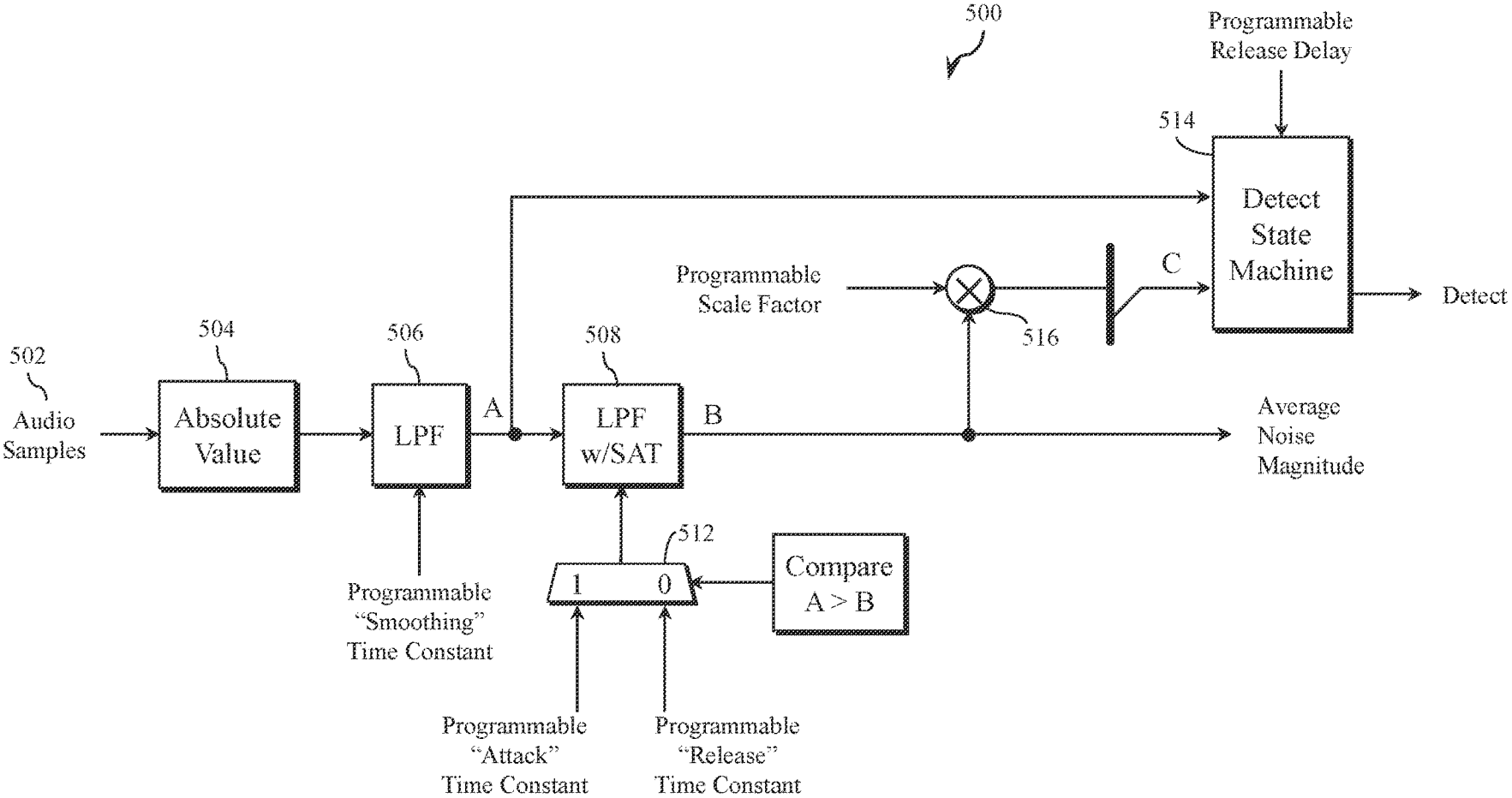
FIG. 5 illustrates a transient activity detector for an adaptive noise cancellation system in accordance with one or more embodiments of the present disclosure.

Referring to FIG. 5, embodiments of a transient activity detector (TAD) 500 are illustrated. In operation, the TAD 500 detects changes in the sound environment and causes an update process to be temporarily halted when sudden/intermittent noise activity is detected. As a result, the unwanted adaptation artefacts in the anti-noise signal (e.g., artefacts that might result from rapid adaptation) are minimized. Examples of transient events might include talking by the headset wearer, honking car horns, head movements, and other similar sound events. A separate set of TAD calculations may be performed on the inputs from each microphone in an ANC system (e.g., a total of 4 microphones in a headset including left error microphone, left outside microphone, right error microphone, right outside microphone). Each of the four microphones may be enabled or disabled independently.

An embodiment of transient activity detection processing for a microphone is illustrated in FIG. 5. A detection state machine 514 is used to assert and de-assert the "detect" output. In various embodiments, the detect output will be asserted when the smoothed instantaneous magnitude (output A from the LPF 506) is greater than the scaled average noise magnitude (C in disclosure). After the smoothed instantaneous magnitude A falls below the scaled average noise magnitude C, a release delay counter will cause the detect output to persist for a programmable period of time before being de-asserted.

In the illustrated embodiment, audio samples 502 from a microphone (e.g., reference microphone or error microphone) are received and fed through an absolute value block 504 followed by a low pass filter 506 to generate the smoothed instantaneous magnitude A. In one embodiment, the output A comprises an average magnitude of the audio samples 502 over a certain period of time and is representative of an instantaneous noise value. The value A is provided to a detect state machine 514, and to a low pass filter 508 with saturation which has an output B representing an average of the A values over a second period of time (i.e., average noise magnitude). A programmable scale factor defines a threshold for detecting transients (e.g., 5 times the average noise magnitude) and is multiplied at component 516 by the average noise magnitude to produce a second input C to the detect state machine 514.

In one embodiment, if the smoothed instantaneous noise magnitude A is greater than the scaled average noise magnitude C, then the detect state machine 514 is operable to instruct the adaptation processing (e.g., adaptation block 220 of FIG. 2) to stop. In various embodiments, the adaptation will freeze until the instantaneous noise magnitude A is below the scaled average noise magnitude C. Referring to FIG. 2, when the adaptation is stopped, filter 202 and gain adjust 204 will continue to modify the noise input x(n) using the most recent weights and gain values. In some embodiments, a programmable release delay counter is operable to maintain the detect output for a programmable period of time before being de-asserted. Further, attack and release component 512 is operable to control how quickly the low pass filter 508 rises and falls in response to the instantaneous noise magnitude A. A programmable attack time constant defines a time it takes for the average noise magnitude to rise when the instantaneous noise is greater than the average noise magnitude B. A programmable release time constant defines a time it takes for the average noise magnitude B to fall when the instantaneous noise magnitude A is lower than the average noise magnitude B.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. An adaptive noise cancellation system comprising:

a reference sensor operable to sense environmental noise and generate a corresponding reference signal;

an error sensor operable to sense noise in a noise cancellation zone and generate a corresponding error signal;

a noise cancellation filter operable to receive the reference signal and generate an anti-noise signal to cancel the environmental noise in the noise cancellation zone; and an adaptation module operable to receive the reference signal and the error signal and adaptively adjust the anti-noise signal;

wherein the noise cancellation filter is tuned during a tuning stage to facilitate extended cancellation bandwidth based at least on noise travelling at least partially between the error sensor and an eardrum reference point and an anti-noise signal at least partially between the error sensor and the eardrum reference point.

2. The adaptive noise cancellation system of claim 1, wherein the noise follows a path between the environmental noise and the eardrum reference point, and the anti-noise signal follows a path between the noise cancellation filter and the eardrum reference point.

3. The adaptive noise cancellation system of claim 1, further comprising a transient activity detection module operable to receive the reference signal, detect a transient noise event and selectively disable the adaptation module during the detected transient noise event.

4. The adaptive noise cancellation system of claim 3, wherein the transient noise event includes talking by an operator of the adaptive noise cancellation system.

5. The adaptive noise cancellation system of claim 3, wherein the transient activity detection module comprises a state machine operable to detect the transient noise event and transmit a state command to the adaptation module; and wherein the adaptation module is operable to receive the state command and enable and/or disable the adaptation in accordance therewith.

6. The adaptive noise cancellation system of claim 1, wherein the adaptation module comprises a noise amplification control module operable to adaptively control noise amplification in at least one hiss region of the anti-noise signal, while achieving cancellation in non-hiss regions of the anti-noise signal.

7. The adaptive noise cancellation system of claim 6, wherein the hiss region of the anti-noise signal includes frequency bandwidths in which constructive interference between the environmental noise and the anti-noise signal is detected.

8. The adaptive noise cancellation system of claim 6, wherein the noise amplification control module is operable to define a composite error signal that incorporates a noise-shaping filter and derives new weight update rules for the noise cancellation filter.

9. The adaptive noise cancellation system of claim 1, further comprising a variable gain component, wherein the adaptation module is operable to adaptively adjust weights of the noise cancellation filter and/or the variable gain component, and wherein the adaptation module comprises an adaptive gain control block operable to update the variable gain component.

10. A method for active noise cancellation comprising:

receiving a reference signal from a first sensor, the reference signal representing external noise;

processing the reference signal through a noise cancellation filter to generate an anti-noise signal;

outputting the anti-noise signal to a loudspeaker;

receiving an error signal from a second sensor, the error signal representing noise in a noise cancellation zone; and adaptively adjusting the noise cancellation filter in response to the reference signal, the error signal and a noise amplification control process;

wherein the noise cancellation filter is tuned during a tuning stage to facilitate extended cancellation bandwidth based at least on noise travelling at least partially between the second sensor and an eardrum reference point and an anti-noise signal at least partially between the second sensor and the eardrum reference point.

11. The method of claim 10, wherein the noise follows a path between the external noise and the eardrum reference point, and the anti-noise signal follows a path between the noise cancellation filter and the eardrum reference point.

12. The method of claim 10, further comprising detecting a transient noise event and selectively setting a transient noise detection state to enable and disable, respectively, the adaptively adjusting the noise cancellation filter.

13. The method of claim 12, wherein the transient noise event includes talking by a user.

14. The method of claim 12, wherein selectively setting the transient noise detection state comprises transmitting a state command; and wherein the adaptively adjusting the noise cancellation filter further comprises receiving the state command and enabling and disabling, respectively, the adaptation in accordance therewith.

15. The method of claim 10, wherein the noise amplification control process comprises adaptively controlling noise amplification in at least one hiss region of the anti-noise signal, while achieving cancellation in non-hiss regions of the anti-noise signal.

16. The method of claim 15, wherein the hiss region of the anti-noise signal includes frequency bandwidths in which constructive interference between the external noise and the anti-noise signal is detected.

17. The method of claim 15, wherein the noise amplification control process further comprises defining a composite error signal that incorporates a noise-shaping filter and deriving new weight update rules for the noise cancellation filter.

18. The method of claim 10, wherein the step of processing the reference signal further comprises processing the reference signal through a variable gain component, and wherein the step of adaptively adjusting the noise cancellation filter comprises adaptively adjusting weights of the noise cancellation filter and/or the variable gain component.

* * * * *